US006149468A

United States Patent [19]

Meng

[11] Patent Number: 6,149,468

[45] Date of Patent: Nov. 21, 2000

[54] CARD EDGE CONNECTOR

[75] Inventor: Ching-Chang Meng, Tu-Chen, Taiwan

[73] Assignee: Hon Hai Precision Ind. Co., Ltd., Taipei Hsien, Taiwan

[21] Appl. No.: 09/363,068

[22] Filed: Jul. 28, 1999

[30] Foreign Application Priority Data

Feb. 2, 1999 [TW] Taiwan ..... 88201718

[51] Int. Cl.[7] ..... H01R 9/09

[52] U.S. Cl. ..... 439/637

[58] Field of Search ..... 439/637, 636, 439/630, 924.1, 862

[56] References Cited

U.S. PATENT DOCUMENTS

| | | | |
|---|---|---|---|
| 5,273,461 | 12/1993 | Lee | 439/924.1 |
| 5,620,342 | 4/1997 | Kinross | 439/637 |
| 5,779,507 | 7/1998 | Yeh | 439/637 |

*Primary Examiner*—Gary F. Paumen

*Attorney, Agent, or Firm*—Wei Te Chung

[57] ABSTRACT

A card edge connector comprises an insulative housing, a number of first contacts and a corresponding number of second contacts. The housing defines a card receiving slot and a number of contact receiving cavities. The first and second contacts have spring portions including individual contacting portions that are located at different levels from a top face of the housing and are spaced a height which is greater than a vertical length of a tapered front edge of a daughter card mated with the connector. The spring portion of the second contact forms an S-shaped portion having a lower turning point spaced from a retention portion of the second contact a distance less than the vertical length of a free end of the second contact above a bottom face of the prestress portion that the free end of the second contact bears against. The S-shaped portion adjusts the length of the spring portion of the second contact when the daughter card is inserted into the housing and therefore prevents the second contact from buckling during insertion of the daughter card into the card receiving slot.

6 Claims, 3 Drawing Sheets

CARD EDGE CONNECTOR

BACKGROUND OF THE INVENTION

The present invention relates to a card edge connector, and particularly to a low insertion force (LIF) card edge connector.

Taiwan Patent Application Nos. 84218094 and 85219875 each disclose an LIF card edge connector including an insulative housing, a plurality of first contacts and a plurality of second contacts. Each first and second contact has a spring portion including a contacting portion which are located at different levels of the housing to generate a height therebetween. When a daughter card is inserted into the connector, an edge end of the daughter card first engages the first contacts having contacting portions proximate the top face of the housing and then engages the second contacts having contacting portions distal from the top face of the housing. Thus, the edge of the daughter card only engages half of the contacts at the same time thereby reducing the insertion force.

However, the spring portions of the first and second contacts have different lengths adapting for the height between the contacting portions thereof. While the daughter card is inserted into the connector, at least a first force and a second force being respectively parallel and perpendicular to a direction in which the daughter card is inserted in the connector are exerted on the first and second contacts by the daughter card. The first force buckles the contacts since each contact has a limited resiliency and is not able to withstand stresses exerted thereon. The second force produces a wear between each contact and a corresponding gold finger mounted on the end edge of the daughter card. The second force exerted on the first contact is different from the second force exerted on the second contact because the lengths of the spring portions of the first and second contacts are different in longitudinal direction. The difference between the second forces exerted on the first and second contacts results in different degrees of wear out between the first contact and the corresponding gold finger, and the second contact and the corresponding gold finger. Thus, one type of the first and second contacts is easily damaged than the other type of the first and second contacts after repeated insertions/withdrawals of a daughter card, which results in the connector being unusable while the other type of contact is still usable.

U.S. Pat. No. 5,201,663 discloses an electrical connector which comprises a first housing part, a second housing part and a plurality of contacts accommodated in the first and second housing parts. Each contact comprises a U-shaped contact spring portion received in the first housing part, a post portion or a leg portion held in the second housing part and an intermediate, resilient spring portion interconnecting the spring portion to the post or leg portion. The spring portion has a general S-shape to allow movement between the spring portion and the post or leg portion in three orthogonal directions. The first housing part is movable with respect to the second housing part when a mating connector engages/disengages the connector. The design of the S-shaped spring portion, however, does not concern a controlled bulking and a regulated contact normal force. Hence, an improved card edge connector is required.

BRIEF SUMMARY OF THE INVENTION

A first object of the present invention is to provide a card edge connector whose contacts have an improved structure to prevent buckling of the contacts from occurring when a daughter card is inserted into the connector.

A second object of the present invention is to provide a card edge connector whose contacts produce generally equal degrees of wear out between the contacts and opposite faces of a daughter card inserted in the connector.

Accordingly, a card edge connector comprises an insulative housing, a number of first contacts and a corresponding number of second contacts. The housing defines a card receiving slot and a number of contact receiving cavities. The first and second contacts have spring portions including individual contacting portions that are located at different levels distanced from a top face of the housing and are spaced a height which is greater than a vertical length of a tapered front edge of a daughter card mated with the connector. The spring portion of the second contact forms an S-shaped portion having a lower turning point spaced from a retention portion of the second contact a distance less than the vertical length of a free end of the second contact above a bottom face of the prestress portion that the free end of the second contact bears against. The S-shaped portion adjusts the length of the spring portion of the second contact when the daughter card is inserted into the housing and therefore produces generally equal degrees of wear out between the contacts and opposite faces of the daughter card inserted in the connector.

Other objects, advantages and novel features of the invention will become more apparent from the following detailed description of the present embodiment when taken in conjunction with the accompanying drawings.

DETAILED DESCRIPTION OF THE INVENTION

Figure 1:
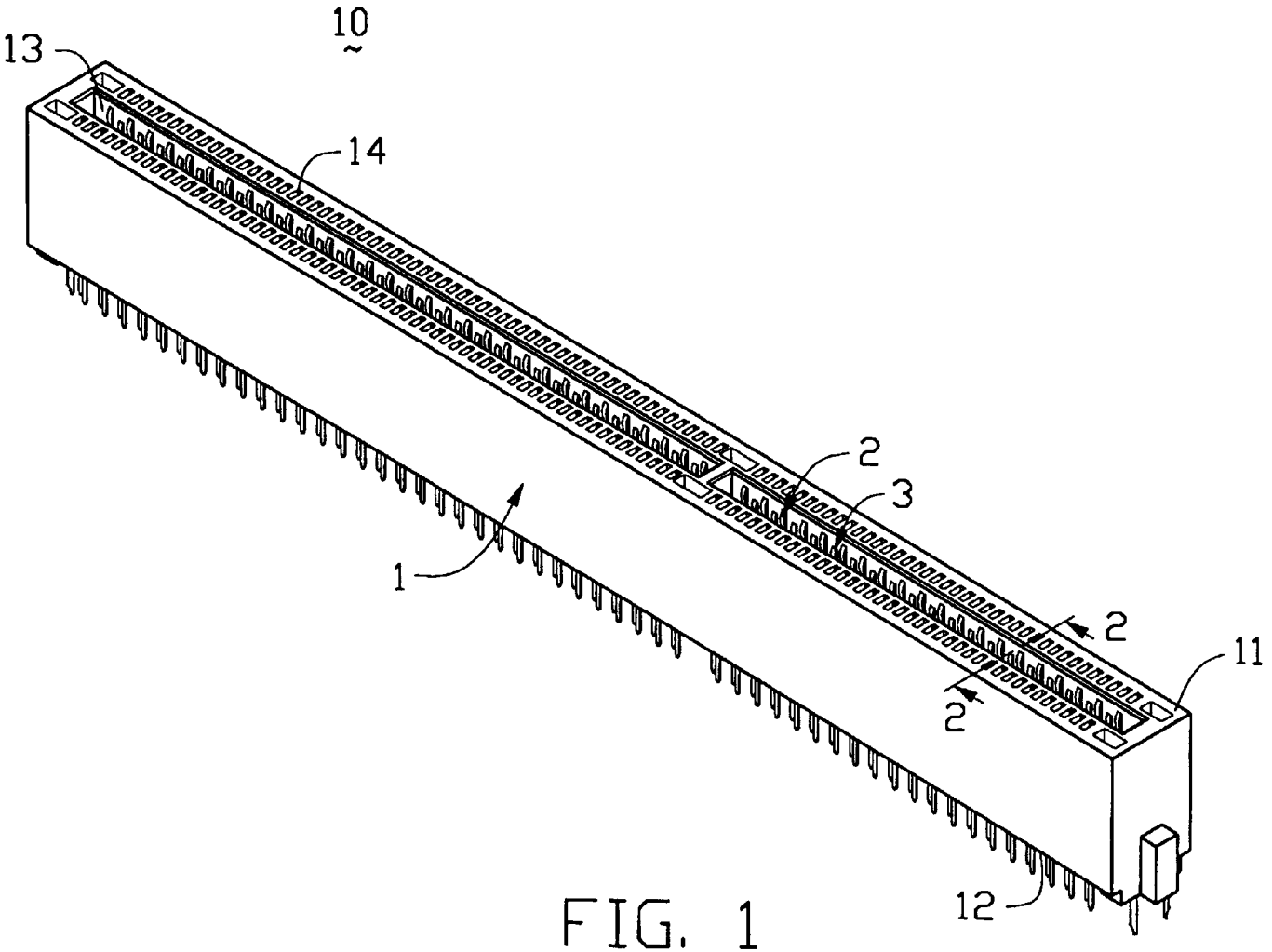
FIG. 1 is a perspective view of a card edge connector of the present invention.
Figure 3:
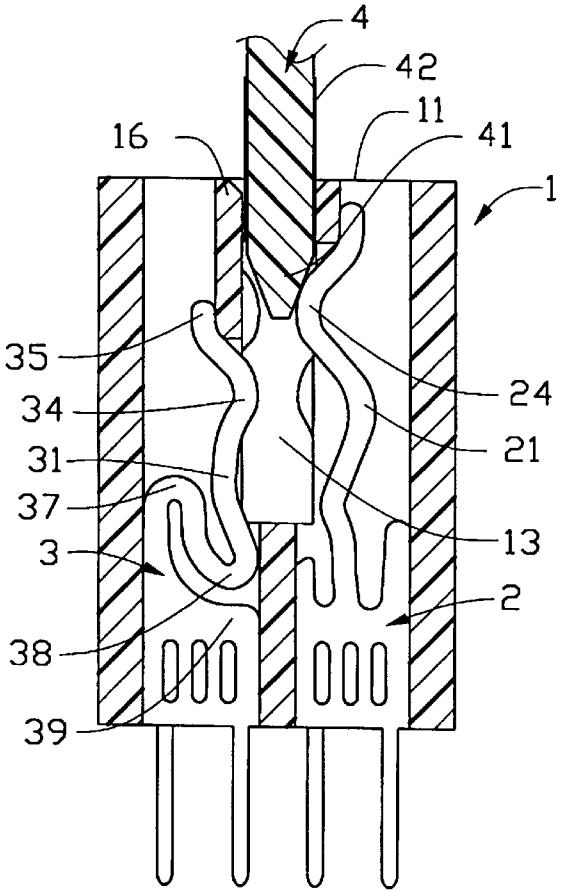
FIG. 3 is a view similar to FIG. 2 illustrating a daughter card being inserted into the card edge connector with a tapered front edge thereof abutting against contacting portions of first contacts of the card edge connector.
Figure 2:
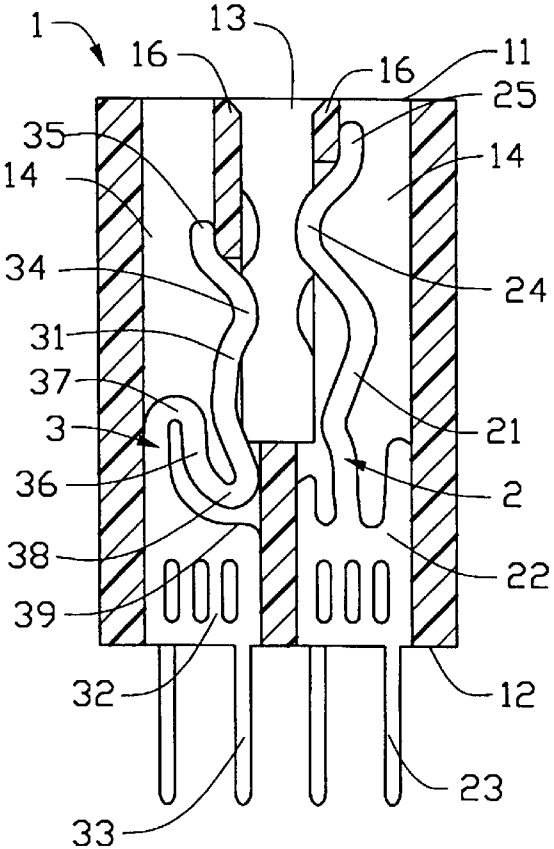
FIG. 2 is a cross-sectional view of the card edge connector taken along the line 2—2 of FIG. 1.

Referring to FIGS. 1 and 2, a card edge connector 10 of the present invention includes a housing 1, a plurality of first contacts 2 and a plurality of second contacts 3. The housing 1 forms a mating face 1, a mounting face 12 opposite the mating face 11, and a slot 13 defined in the mating face 11 for receiving a daughter card 4 having a tapered front edge 41 (FIG. 3). The housing 1 defines a plurality of contact receiving cavities 14 between the mating and mounting faces 11, 12. A prestress portion 16 is provided adjacent to each cavity 14 for free end 25 (35) of the contact 2 (3) to abut against thereby creating a pre-load therebetween. The slot 13 communicates with the cavities 14 below the prestress portions 16.

The first contact 2 is stamped from sheet of metal material to form a spring portion 21, a retention portion 22 and a tail 23 extending from the retention portion 22. The spring portion 21 has a contacting portion 24 extending into the slot 13 of the housing 1 for contacting the daughter card 4 (described later). The second contact 3 also has a spring portion 31, a retention portion 32 and a tail 33. The spring portion 31 comprises a contacting portion 34 extending into the slot 13 of the housing 1 and an S-shaped portion 36 connected to the retention portion 32. The S-shaped portion 36 is bent twice in opposite directions causing the contacting portion 34 to be lowered a predetermined distance without reducing the length of the spring portion 31. The S-shaped portion 36 forms a first turning point 37 and a second turning point 38 at positions where the S-shaped portion 36 is bent. The retention portion 32 has a supporting section 39 below the second turning point 38 and a height is defined therebetween.

Figure 5:
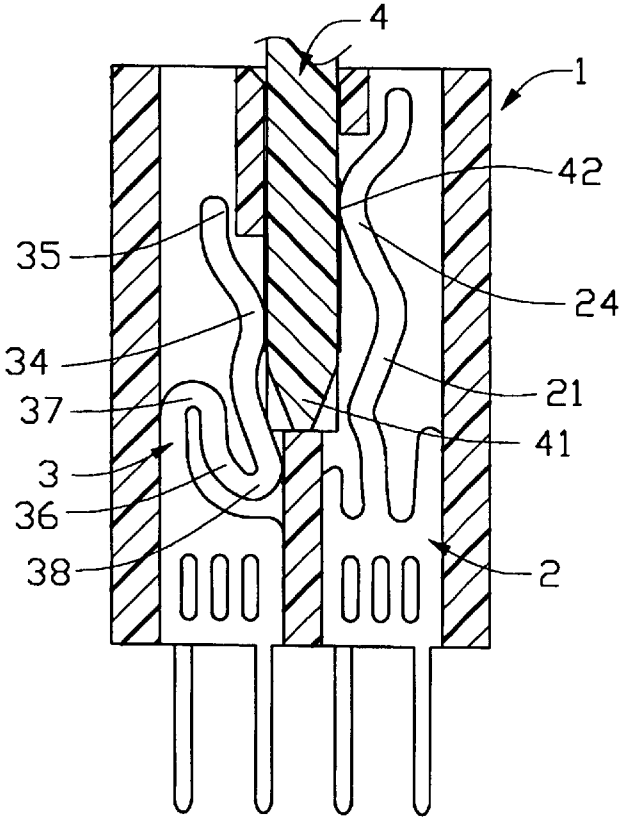
FIG. 5 is a view similar to FIG. 3 but the conductive elements of the daughter card abut against contacting portions of the first and second contacts of the card edge connector.

In assembly, the first and second contacts 2, 3 are inserted into the corresponding cavities 14 from the mounting face 12 of the housing 1. Each first contact 2 is positioned between a pair of second contacts 3 on the same side of the slot 13 and is transversely opposite a second contact 3 on the opposite side of the slot 13. The contacting portion 34 of each second contact 3 being positioned at a level below the contacting portion 24 of the first contact 2 and a distance formed therebetween that is larger than the vertical length of the tapered front edge 41 of the daughter card 4. The tails 23, 33 extend beyond the mounting face 12 of the housing 1 for mounting to a circuit board (not shown). The contacting portions 24, 34 extend into the slot 13 for contacting with conductive elements 42 of the daughter card 4 (FIG. 5). The free ends 25, 35 abut against the prestress portions 16 of the housing 1 to form a pre-load therebetween. The vertical length of the free ends 35 above a bottom face of the prestress portion 16 that the free end 35 bears against is greater than the height between the supporting section 39 and the second turning point 38.

Figure 4:
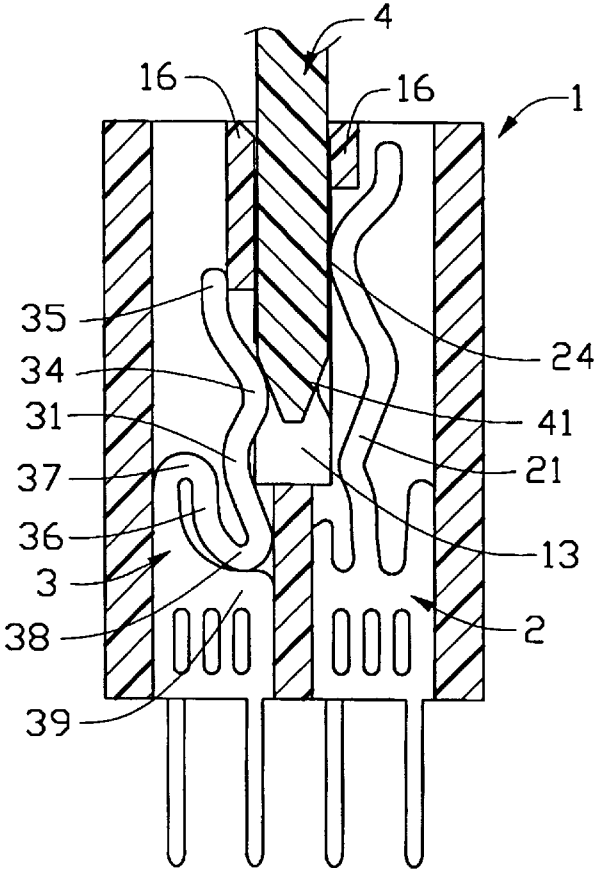
FIG. 4 is a view similar to FIG. 3 but the tapered front edge of the daughter card abuts against contacting portions of second contacts of the card edge connector and conductive elements of the daughter card abut against contacting portions of the first contacts of the card edge connector.

Referring to FIGS. 3 to 5, when the daughter card 4 is inserted into the slot 13 of the housing 1 from the mating face 11, the tapered front edge 41 abuts against the contacting portions 24 of the first contacts 2 and the contacting portions 24 slide along a surface of the daughter card 4 (FIG. 3). The tapered front edge 41 then abuts against the contacting portions 34 of the second contacts 3 and the contacting portions 34 slide therealong. The spring portion 31 is urged downwardly about the first turning point 37 until the second turning point 38 abuts against the supporting section 39 (FIG. 4). The contacting portion 34 of the second contact 3 downwardly moves along the tapered front edge 41 of the daughter card 4 and then upwardly slides along the surface of the daughter card 4 result in the second turning point 38 separating from the supporting section 39 (FIG. 5).

Since the contacting portion 34 of the second contact 3 is positioned at a level below the contacting portion 24 of the first contact 2 and a height therebetween is greater than the vertical length of the tapered front edge 41 of the daughter card 4, the tapered front edge 41 of the daughter card 4 only abuts against either the first contacts 2 or the second contacts 3 at any given time, thus, the insertion force is low. The S-shaped portion 36 prevents the second contact 3 from buckling during insertion of the daughter card 4 into the card receiving slot 13 of the housing 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for establishing an electrical connection between a daughter card and a printed circuit board, the card edge connector comprising:

an insulative housing including a card receiving slot, a plurality of contact receiving cavities opening to the slot, and a plurality of pre-load portions each being provided between the slot and a corresponding cavity;

a plurality of first contacts each having a spring portion, a tail and an intermediate retention portion, the retention portion being secured in a corresponding cavity of the housing, the spring portion and the tail extending from opposite edges of the retention portion, the spring portion forming a contacting portion extending into the slot of the housing, the spring portion having a free end bearing against a corresponding pre-load portion of the housing; and a plurality of second contacts each having a spring portion, a tail and an intermediate retention portion, the retention portion being secured in a corresponding cavity of the housing, the spring portion and the tail extending from opposite edges of the retention portion, the spring portion having a contacting portion extending into the slot and an S-shaped portion interconnected between the contacting portion and the retention portion, the S-shaped portion forming a turning point opposing the retention portion, the spring portion having a free end bearing against a corresponding pre-load portion of the housing;

wherein the contacting portions of the first and second contacts apply substantially the same normal force to the daughter card while the spring portion of the second contact moves downward with respect to a corresponding pre-load portion of the housing to reduce an effective length thereof until the turning point of the S-shaped portion of the second contact abuts against the retention portion of the second contact during insertion of the daughter card into the connector.

2. The card edge connector as claimed in claim 1, wherein each pre-load portion of the housing forms a bottom face and the free end of the spring portion of the second contact is kept at a level above the bottom face during insertion of the daughter card into the connector.

3. The card edge connector as claimed in claim 1, wherein there are two rows of contacts in the housing and the first and second contacts are alternatingly disposed in the cavities of the housing.

4. The card edge connector as claimed in claim 1, wherein the spring portion of the second contact upwardly moves a distance and the turning point of the S-shaped portion moves away from the retention portion of the second contact after a tapered front edge of the daughter card moves across the engaging portion of the second contact.

5. The card edge connector as claimed in claim 1, wherein the first and second contacts have the same width.

6. A card edge connector assembly for establishing electrical connection to a printed circuit board, comprising:

an insulative housing including a card receiving slot, a plurality of contact receiving cavities opening to two opposite sides of the slot, a prestress portion provided adjacent to each of said cavities;

a plurality of contacts each including a spring portion, a tail and a retention portion, said spring portion further defining thereof an upper end portion, and a contacting portion projecting into the slot to engage a daughter board which is received within the slot, said daughter board defining a tapered front edge thereof; and a turning point formed on the spring portion, and a supporting section formed on one of said contact and the housing; whereby before the daughter board is inserted into the slot, said turning point and said supporting section are spaced from each other and the upper end portion engages the prestress portion, but when the daughter is inserted into the slot, the tapered front edge presses down the contacting portion until the turning point abuts against the supporting section, wherein the upper end portion still engages the prestress portion until the contacting portion leaves the tapered front edge and engages the conductive element on the daughter board, and simultaneously the turning point leaves the supporting section and the end portion leaves the prestress portion.

* * * * *